US010882268B2

(12) United States Patent
Nakamura et al.

(10) Patent No.: US 10,882,268 B2
(45) Date of Patent: Jan. 5, 2021

(54) BOX-MAKING APPARATUS

(71) Applicant: ISHIDA CO., LTD., Kyoto (JP)

(72) Inventors: Yuichi Nakamura, Ritto (JP); Atsushi Takahashi, Ritto (JP); Tatsuya Iwasa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 16/040,234

(22) Filed: Jul. 19, 2018

(65) Prior Publication Data

US 2019/0022967 A1 Jan. 24, 2019

(30) Foreign Application Priority Data

Jul. 20, 2017 (JP) ..... 2017-141246

(51) Int. Cl.

| | |
|---|---|
| ***B31B 50/72*** | (2017.01) |
| ***B31B 50/00*** | (2017.01) |
| ***B65B 51/06*** | (2006.01) |
| ***B65B 7/16*** | (2006.01) |
| ***B65B 7/20*** | (2006.01) |
| ***B65B 57/02*** | (2006.01) |

(Continued)

(52) U.S. Cl.

CPC ..... *B31B 50/722* (2017.08); *B31B 50/0044* (2017.08); *B65B 7/16* (2013.01); *B65B 7/20* (2013.01); *B65B 51/067* (2013.01); *B65B 57/02* (2013.01); *B31B 2100/0022* (2017.08); *B31B 2110/35* (2017.08)

(58) Field of Classification Search

CPC ..... B31B 50/722; B31B 50/0044; B31B 2100/0022; B31B 2110/35; B65B 7/16; B65B 7/20; B65B 51/067; B65B 57/02; B65B 57/04; B65B 57/06; B65B 57/08

See application file for complete search history.

(56) References Cited

U.S. PATENT DOCUMENTS 5,735,101 A 4/1998 Shing-Tak Lam
6,363,690 B1 * 4/2002 Lay ..... B65B 43/123 53/136.4

(Continued)

FOREIGN PATENT DOCUMENTS

CN 203805522 U 9/2014
CN 205381458 U 7/2016

(Continued)

OTHER PUBLICATIONS

Extended European Search Report of the corresponding European Patent Application No. 18184593.4, dated Sep. 24, 2018.

(Continued)

*Primary Examiner* — George R Koch
(74) *Attorney, Agent, or Firm* — Global IP Counselors, LLP

(57) ABSTRACT

A box-making apparatus includes an electronic controller assesses abnormalities in the affixing of tape on the basis of a timing at which a cardboard box passes a detection position Pd, and a timing at which a tape roll starts or stops an action of unreeling the tape. The electronic controller assesses abnormalities in the affixing of tape also when there is a discrepancy of at least a predetermined amount between the timing at which the cardboard box passes the detection position and the timing at which the tape roll starts or stops the action of unreeling the tape.

9 Claims, 10 Drawing Sheets

(51) Int. Cl.
*B31B 110/35* (2017.01)
*B31B 100/00* (2017.01)

(56) References Cited

U.S. PATENT DOCUMENTS

| | | | | |
|---|---|---|---|---|
| 2004/0065047 | A1 | 4/2004 | Miyamoto et al. | |
| 2007/0107825 | A1 | 5/2007 | Bredl et al. | |
| 2012/0232699 | A1* | 9/2012 | Menta | B65H 35/0013 700/275 |
| 2014/0094354 | A1 | 4/2014 | Lam | |

FOREIGN PATENT DOCUMENTS

| | | | |
|---|---|---|---|
| EP | 0644144 | A1 | 3/1995 |
| JP | H04-18215 | A | 1/1992 |
| JP | H07-4460 | U | 1/1995 |
| JP | H07-33126 | A | 2/1995 |
| JP | H07-237796 | A | 9/1995 |
| JP | H09-207243 | A | 8/1997 |
| JP | H11-35013 | A | 2/1999 |
| JP | 2002-053104 | A | 2/2002 |
| JP | 5647825 | B2 | 1/2015 |
| JP | 2016-011173 | A | 1/2016 |
| WO | 0041960 | A1 | 7/2000 |
| WO | 02098737 | A1 | 12/2002 |

OTHER PUBLICATIONS

English Translation of Reasons for Submission by third party filed Oct. 21, 2019 at Japanese Patent Office in the corresponding Japanese Patent Application No. 2017-141246.

An Office Action of the corresponding Chinese Patent Application No. 201810801189.2, dated Mar. 26, 2020.

English Translation of the Office Action of the corresponding Chinese Patent Application No. 201810801189.2 dated Nov. 10, 2020.

* cited by examiner

BOX-MAKING APPARATUS

TECHNICAL FIELD

The present invention relates to a box-making apparatus, and particularly relates to a box-making apparatus provided with a tape-affixing section that uses tape to seal a lid of a cardboard box that is being conveyed.

BACKGROUND ART

Conventionally, in cardboard box-making apparatuses, e.g., in the box-making apparatus disclosed in Japanese Laid-open Patent Publication No. H9-207243, when a cardboard box is conveyed in, a roller to guide adhesive tape rolls over an upper surface of a cardboard box while affixing tape to a front-surface upper part of the box, the tape is affixed to the upper surface, the tape is then affixed to a back-surface upper part while being lowered from an upper-surface end, and the tape is cut. A worker visually confirms the box ejected from the box-making apparatus in order to confirm whether or not the tape has been appropriately affixed.

SUMMARY OF THE INVENTION

Technical Problem

From the perspective of improving productivity, consideration has been given to abolishing the visual inspection by implementing an automatic inspection, such as confirming through a sensor that the tape has been pulled taut.

However, when a sensor is set with the presupposition that the tape is transparent, there is a risk of erroneous detection when tape with colors and/or patterns is used.

In view of this, an object of the present invention is to provide a box-making apparatus in which the tape-affixing action can be reliably detected.

Solution to Problem

A box-making apparatus according to a first aspect of the present invention comprises a tape-affixing section, a detection unit, a conveying section, and a control unit. The tape-affixing section affixes tape unreeled from a tape roll to a cardboard box assembled into the form of a box. The detection unit detects an action of unreeling the tape from the tape roll. The conveying section conveys the cardboard box during tape affixing. The control unit monitors the conveyed state of the cardboard box and the unreeled state of the tape and assesses abnormalities in the affixing of the tape.

In this box-making apparatus, when the unreeled state of the tape is not detected despite the cardboard box being conveyed through the tape-affixing area, the control unit can assess that there is an abnormality in the affixing of the tape, and automatic inspection not involving visual inspection is therefore possible.

A box-making apparatus according to a second aspect of the present invention is the box-making apparatus according to the first aspect, wherein the control unit assesses abnormalities in the affixing of the tape on the basis of a timing at which the cardboard box passes through a preset conveying position, and a timing at which the unreeling action of the tape is started or stopped.

In this box-making apparatus, the control unit can assess that there is an abnormality in the affixing of the tape when there is a discrepancy of at least a predetermined amount between the timing at which the cardboard box passes a preset conveying position and the timing at which the unreeling action of the tape is started or stopped.

A box-making apparatus according to a third aspect of the present invention is the box-making apparatus according to the first or second aspect, wherein the detection unit detects the unreeling action of the tape from a rotating action of the tape roll.

In this box-making apparatus, whether or not tape is being affixed to the cardboard box can be detected primarily through whether or not the rotating action of the tape roll is occurring, and erroneous detection is therefore rare.

A box-making apparatus according to a fourth aspect of the present invention is the box-making apparatus according to any of the first through third aspects, further comprising a circular plate. The circular plate has a slit provided in a predetermined position and rotates in synchronization with the tape roll. The detection unit detects the slit and sends a detection signal to the control unit.

In this box-making apparatus, due to the detection signal sent from the detection unit, the control unit not only can assess whether or not the rotating action of the tape roll, i.e., the tape unreeling action is occurring, but can also assess whether or not the tape is cut properly from the continuity of the detection signal, and furthermore can estimate the consumed amount of tape from a rotation cycle.

A box-making apparatus according to a fifth aspect of the present invention is the box-making apparatus according to the fourth aspect, wherein the detection unit is a sensor to emit an on or off signal when the slit is detected.

A box-making apparatus according to a sixth aspect of the present invention is the box-making apparatus according to the first aspect, wherein the detection unit is an optical sensor to monitor the tape unreeled from the tape roll.

A box-making apparatus according to a seventh aspect of the present invention is the box-making apparatus according to the first aspect, wherein the detection unit is a camera to monitor the tape unreeled from the tape roll.

A box-making apparatus according to an eighth aspect of the present invention is the box-making apparatus according to any one of the first through seventh aspects, wherein the control unit stops operation during a period during which operation is readily restarted when the control unit assesses that there has been an abnormality in the affixing of the tape.

Effects of the Invention

In the box-making apparatus according to the present invention, when the unreeled state of the tape is not detected despite the cardboard box being conveyed through the tape-affixing area, the control unit can assess that there is an abnormality in the affixing of the tape, and automatic inspection not involving visual inspection is therefore possible.

DESCRIPTION OF EMBODIMENTS

An embodiment of the present invention is described with reference to the drawings. The following embodiment is a specific example of the present invention and is not intended to limit the technical range of the present invention.

(1) Configuration of Box-Packing System 1

Figure 1:
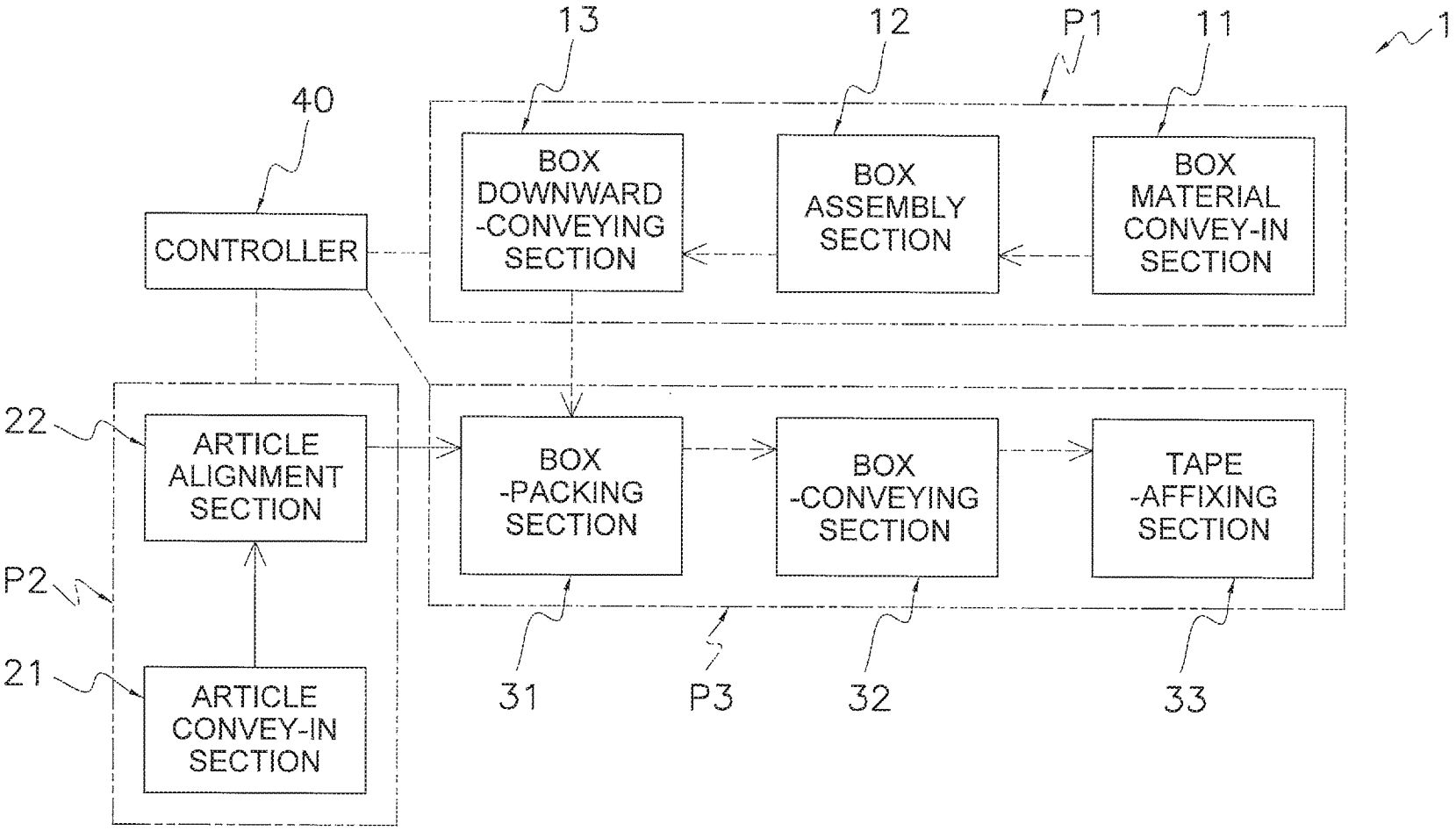
FIG. 1 is a block diagram of a box-packing system equipped with a box-making apparatus according to one embodiment of the present invention.
Figure 2:
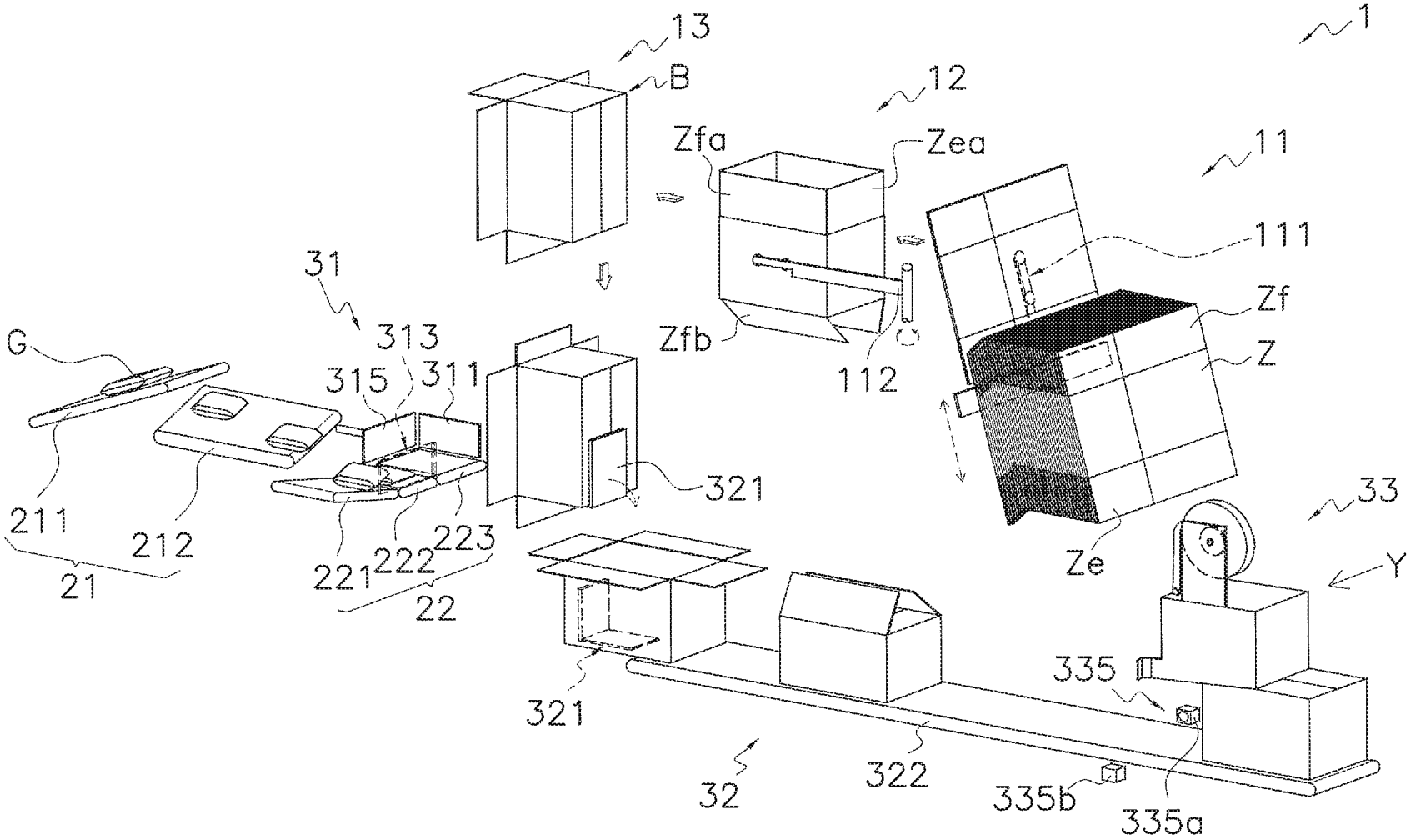
FIG. 2 is a perspective view showing the flow of cardboard boxes and articles in the box-packing system.

FIG. 1 is a block diagram of a box-packing system 1 equipped with a box-making apparatus according to one embodiment of the present invention. FIG. 2 is a perspective view showing the flow of a cardboard box B and articles in the box-packing system 1. In FIG. 1, the box-packing system 1, for example, packs many layers of packaged goods (bags G), such as snack treats, into the cardboard box B in a fixed number and in an aligned state.

In the box-packing system 1, three steps including a box-making step P1, an article alignment step P2, and a box-packing step P3 work in coordination as shown in FIG. 1.

The box-making step P1 is a step of assembling a sheet of cardboard box material Z into a cardboard box B and conveying the box to a box-packing position, and this step is configured from a box material convey-in section 11, a box assembly section 12, and a box downward-conveying section 13.

The article alignment step P2 is a step of conveying in bags G supplied from an upstream step to a predetermined position, aligning a fixed number of bags G so that adjacent bags partially overlap each other, and conveying the bags to a box-packing position, and this step is configured from an article convey-in section 21 and an article alignment section 22.

The box-packing step P3 is a step of packing a fixed numerical quantity of bags G, which have finished being aligned in the article alignment step P2, into a cardboard box B conveyed from the box-making step P1, closing the box, and conveying the box to a box ejection position. This step is configured from a box-packing section 31, a box-conveying section 32, and a tape-affixing section 33.

The box-packing system 1 packs many layers of bags G into the cardboard box B, and the orientation of the bags G in the box B is an "upright orientation." In other words, this is an orientation in which an opening of the box B is made to face upward, front surfaces and back surfaces of the bags G face to the side, upper and lower ends of the bags G face up and down, and left and right sides face to the side.

(1-1) Box-Making Step P1

As shown in FIGS. 1 and 2, the box-making step P1 is configured from: the box material convey-in section 11, which guides the cardboard box material Z into the box-packing system 1; the box assembly section 12, which assembles the cardboard box B; and the box downward-conveying section 13, which adjusts the orientation of the cardboard box B so that the opening and a major top flap Zfa are in the same vertical plane and conveys the cardboard box B downward.

(1-1-1) Box Material Convey-In Section 11

In the box material convey-in section 11, the foremost cardboard box materials Z of the cardboard box materials Z stacked in a supply position are held and delivered upward one at a time, and the delivered cardboard box materials Z are each rotated 90° about a vertical axis and spread into a tube shape, as shown in FIG. 2.

The cardboard box materials Z are placed in the supply position by the worker. The cardboard box materials Z are folded with flaps Zf, Ze left open, and are stacked in a horizontal direction in an orientation such that the flaps Zf, Ze are positioned in a vertical direction. For the sake of convenience in the description, the top-surface-side flaps Zf, Ze are referred to as a major top flap Zfa and a minor top flap Zea, and the bottom-surface-side flaps Zf, Ze are referred to as a major bottom flap Zfb and a minor bottom flap Zeb.

The upward delivery of the cardboard box materials Z is performed by a raising mechanism 111, and when there are no longer any cardboard box materials Z in the supply position, a detection signal of a sensor (not shown) is transmitted to an electronic controller 40 (see FIG. 1).

The rotation of a cardboard box material Z about the vertical axis is achieved due to a side surface of the cardboard box material Z being suction-held by a suction-holding disk of a suction rotary mechanism 112, and the suction rotary mechanism 112 being rotated 90° about the vertical axis by a motor (not shown).

(1-1-2) Box Assembly Section 12

The box assembly section 12 folds in and tapes the bottom flap Zfb of the cardboard box material Z while horizontally conveying the cardboard box material Z spread into a tube shape, and assembles a cardboard box B with the top flap Zfa left open.

(1-1-3) Box Downward-Conveying Section 13

The box downward-conveying section 13 rotates the cardboard box B 90° about a horizontal axis orthogonal to the conveying direction, and conveys the cardboard box B downward after adjusting the orientation so that the opening of the cardboard box B, the major top flap Zfa, and the minor top flap Zea are in the same vertical plane. In other words, the cardboard box B is moved downward while the cube shape thereof formed by the box assembly section 12 is maintained.

(1-2) Article Alignment Step

A weighing device, a bag-making and packaging machine, etc., which are not illustrated, are placed in an upstream step in the flow of bags G in the box-packing system 1. Only bags G that have passed inspections for, e.g., weight, sealing, and contamination in the upstream step are supplied to the box-packing system 1.

The article alignment step P2 is configured from the article convey-in section 21, which receives and conveys the bags G to a predetermined position, and the article alignment section 22, which aligns the bags G supplied from the article convey-in section 21.

(1-2-1) Article Convey-In Section 21

The article convey-in section 21 has an article guide-in conveyor 211 and a convey-in conveyor 212. In the downstream of the step where the inspections for, e.g., weight, sealing, and contamination are performed, the article guide-in conveyor 211 receives the supply of bags G that have passed these inspections and guides the bags to the convey-in conveyor 212.

The convey-in conveyor 212 conveys bags G conveyed from the article guide-in conveyor 211 to the article alignment section 22. The details of the convey-in conveyor 212 are described in the latter half of this document.

(1-2-2) Article Alignment Section 22

The article alignment section 22 has a first alignment conveyor 221, a second alignment conveyor 222, and a third alignment conveyor 223. To receive bags G falling down from the convey-in conveyor 212, the first alignment conveyor 221 is set such that one end is positioned lower than the height of a distal end part of the convey-in conveyor 212, and the other end is positioned at the same height as the second alignment conveyor 222.

The distal end part of the convey-in conveyor 212 is preferably positioned in a space directly above an article placement surface of the first alignment conveyor 221. The article placement surface in this case is a surface that is part of a conveying surface of the first alignment conveyor 221 and that waits for falling bags G.

The bags G on the first alignment conveyor 221 and the second alignment conveyor 222 constitute a row so that bags adjacent to each other will partially overlap.

After the last bag G of the row has settled on the first alignment conveyor 221, activating of the second alignment conveyor 222 and the third alignment conveyor 223 is started, and the first alignment conveyor 221, the second alignment conveyor 222, and the third alignment conveyor 223 perform a conveying action in the same direction. Therefore, N number of bags G aligned in one row on the first alignment conveyor 221 and the second alignment conveyor 222 move all at once to the third alignment conveyor 223 and advance over the third alignment conveyor 223.

(1-3) Box-Packing Step P3

The box-packing step P3 has: the box-packing section 31, which packs bags G into a cardboard box B; the box-conveying section 32, which conveys the cardboard box B after the packing of bags G therein is complete; and the tape-affixing section 33, which folds in the top flap Zfa of the cardboard box B to close the opening surface and completes taping.

(1-3-1) Box-Packing Section 31

The box-packing section 31 holds a group of bags G, which are aligned in a row on the third alignment conveyor 223, at the foremost and hindmost bags and inserts the group of bags G altogether into the cardboard box B. To hold a group of aligned bags G, the box-packing section 31 has a blocking plate 311, a pushing plate 313, and an inserting plate 315, as shown in FIG. 2.

The blocking plate 311 is provided on a downstream end of the third alignment conveyor 223, and this plate blocks the advance of bags G being conveyed as a row. The blocking plate 311 is disposed so that a flat surface part thereof is always orthogonal to the conveyed direction of the bags G.

The pushing plate 313 pushes the hindmost of the N number of bags G aligned in a row, and stands the bags upright with the bags held between the pushing plate 313 and the blocking plate 311. The pushing plate 313 is provided on an upstream end of the third alignment conveyor 223, but while the row of bags G is moving from the second alignment conveyor 222 to the third alignment conveyor 223, a flat surface part is accommodated in a side of the third alignment conveyor 223 so as to be parallel with the conveyed direction of the bags G. Additionally, when the hindmost bag G of the row has completely moved from the second alignment conveyor to the third alignment conveyor 223, the pushing plate 313 turns so that the flat surface part is orthogonal to the conveyed direction of the bags G. Furthermore, the pushing plate 313 pushes the hindmost bag G of the row and brings the entire row toward the blocking plate 311.

At this time, because the blocking plate 311 is fixed in place, the foremost bag G of the row stands upright along the flat surface part of the blocking plate 311, and the next bag G stands upright along the upright foremost bag. Subsequent bags G stand upright in sequence by the same action, and N number of bags G therefore align in an upright state.

The box-packing section 31 collectively pushes N number of upright bags G into a cardboard box B by the inserting plate 315. The inserting plate 315 is positioned on the side of the third alignment conveyor 223 opposite from the position of the cardboard box B. When viewed from the side of the second alignment conveyor 222, the opening surface of the cardboard box B is positioned on the right side of the third alignment conveyor 223, and the inserting plate 315 is positioned on the left side of the third alignment conveyor 223.

The inserting plate 315 waits with a flat surface part facing the opening of the cardboard box B, and after N number of bags G have been stood upright, these bags are pushed toward the opening surface of the cardboard box B, and the N number of bags G are inserted at once in the cardboard box B toward the bottom from the opening. The inserting plate 315 passes between the blocking plate 311 and the pushing plate 313 and advances to the opening surface of the cardboard box B.

(1-3-2) Box-Conveying Section 32

The box-conveying section 32 has an orientation adjustment mechanism 321 that adjusts the orientation of the cardboard box B packed with bags G, and an ejecting conveyor 322 that conveys the cardboard box B.

The orientation adjustment mechanism 321 arranges the opening surface, which had heretofore been vertical, to be horizontal, i.e., rotates the cardboard box B so that the opening surface faces upward. The orientation adjustment mechanism 321 holds the cardboard box B using an L-shaped member with suction-holding disks that simultaneously suction-hold the side surface and bottom surface of the cardboard box B, and the L-shaped member rotates 90°, whereby the cardboard box B rotates.

Having rotated the cardboard box B 90°, the orientation adjustment mechanism 321 places the box on the ejecting conveyor 322 with the opening surface facing upward. The ejecting conveyor 322 conveys the cardboard box B to a predetermined position, but before reaching the predetermined position, folds in the major top flap Zfa and the minor top flap Zea to close the opening surface, and completes taping.

(1-3-3) Tape-Affixing Section 33

Before the tape-affixing section 33 is described, the names of the parts of the cardboard box B are needed for the sake of convenience in the description, and the drawings shall therefore be used for a description with symbols assigned to the names of the parts of the cardboard box B.

Figure 3:
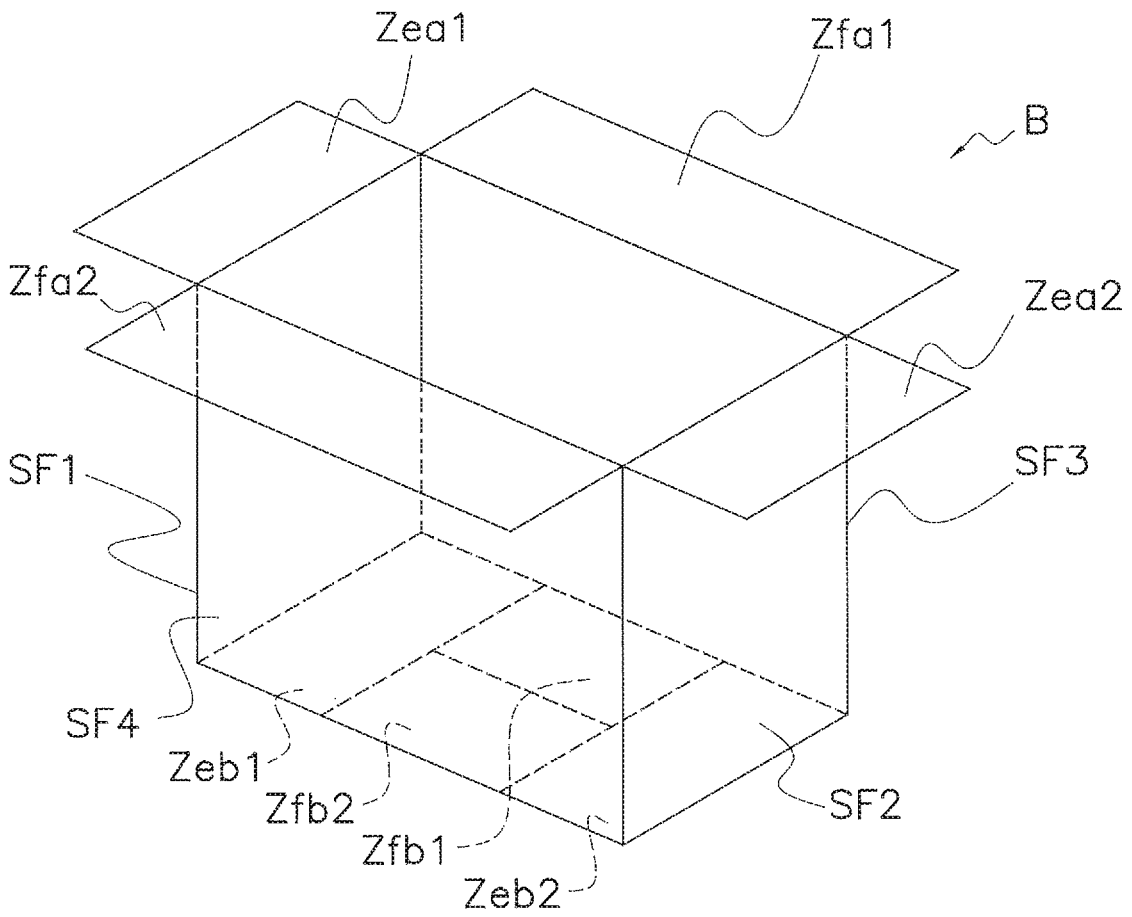
FIG. 3 is a schematic perspective view of a cardboard box.

FIG. 3 is a schematic perspective view of a cardboard box B. In FIG. 3, the cardboard box B has a square tube configured from four side surfaces (a first side surface SF1, a second side surface SF2, a third side surface SF3, and a fourth side surface SF4). Flaps that constitute an upper lid and lower lid extend from both ends of the square tube.

Specifically, one flap each is provided to both ends of the side surfaces SF1, SF2, SF3, SF4 constituting the side surface parts. At the point in time when the cardboard box B is received on the ejecting conveyor 322, the bottom-lid-side flaps are folded in and closed, and the bottom lid is sealed shut by tape T.

Minor top flaps Zea1, Zea2 and major top flaps Zfa1, Zfa2 on the upper-lid side are opened to the outer sides at the point in time when the box is received on the ejecting conveyor 322 (see FIG. 3).

The minor top flaps Zea1, Zea2 are provided to the short sides of the rectangular opening in the side-surface part. The major top flaps Zfa1, Zfa2 are provided to the long sides of the rectangular opening in the side-surface part.

The minor top flap Zea1 extends as a continuation of the first side surface SF1. The minor top flap Zea2 extends as a continuation of the second side surface SF2, which faces the first side surface SF1. The major top flap Zfa1 extends as a continuation of the third side surface SF3. The major top flap Zfa2 extends as a continuation of the fourth side surface SF4, which faces the third side surface SF3.

Figure 4:
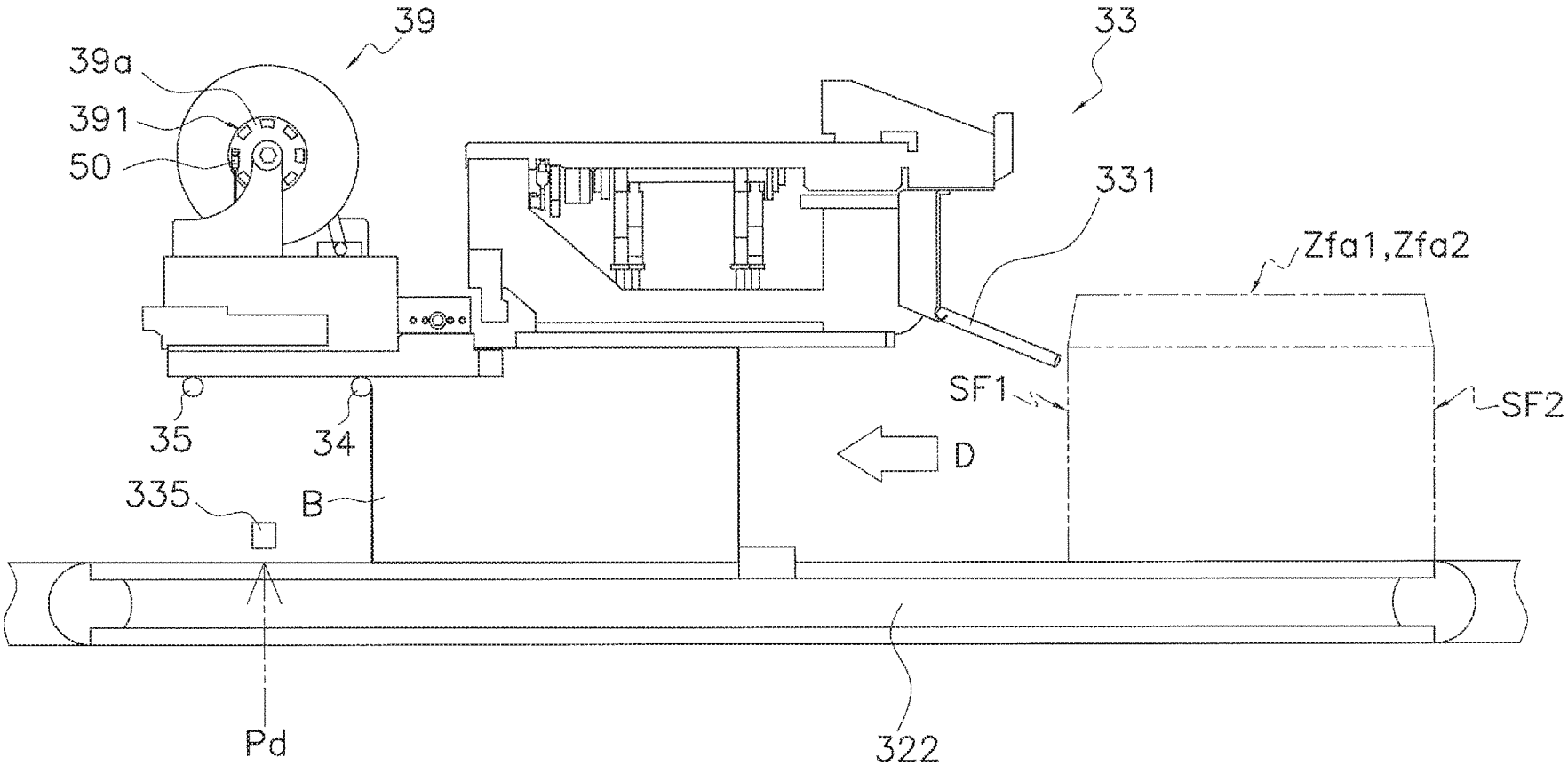
FIG. 4 is a side view of the tape-affixing section as seen from the direction Y in FIG. 1.

FIG. 4 is a side surface view of the tape-affixing section 33 as seen from the direction Y in FIG. 1. In FIG. 4, after the minor top flaps Zea1, Zea2 (see FIG. 3) are folded in advance by a member (not shown) so as to cover the opening of the cardboard box B, a folding rod 331 is driven to push the major top flaps Zfa1, Zfa2, and the major top flaps Zfa1, Zfa2 are closed. The folding rod 331 extends at a predetermined angle with the conveying direction D of the ejecting conveyor 322.

The tape-affixing section 33 continuously affixes tape T to: an upper part of the first side surface SF1, on the downstream side in the conveying direction D of the ejecting conveyor 322, of the cardboard box B conveyed by the ejecting conveyor 322; the border portion between the folded major top flaps Zfa1, Zfa2; and an upper part of the second side surface SF2 facing the first side surface SF1 (the second side surface SF2 on the upstream side in the conveying direction D of the ejecting conveyor 322), and seals the upper lid of the cardboard box B shut.

(2) Detailed Configuration of Tape-Affixing Section 33

Figure 5:
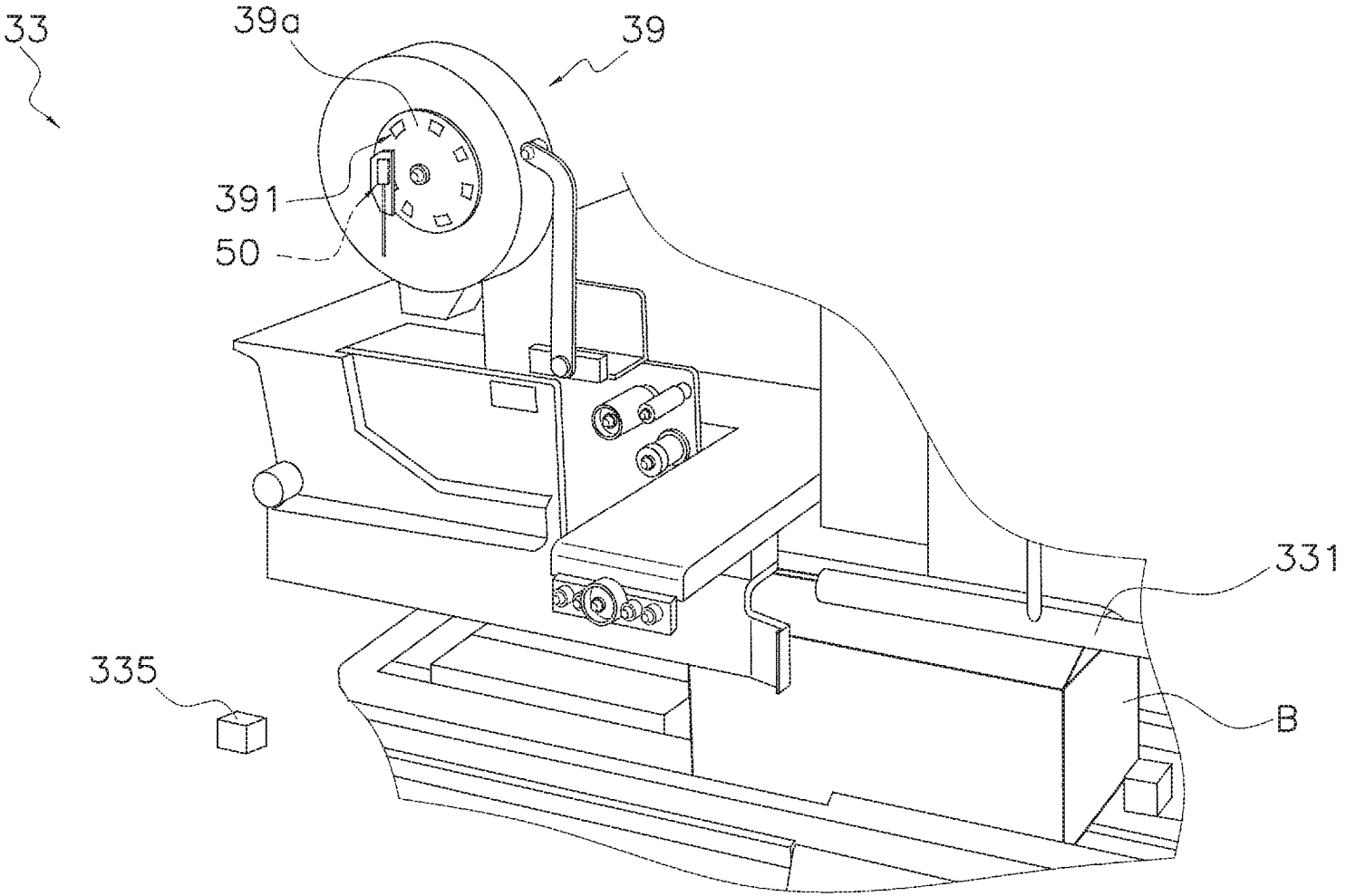
FIG. 5 is a schematic perspective view of the tape-affixing section.
Figure 6A:
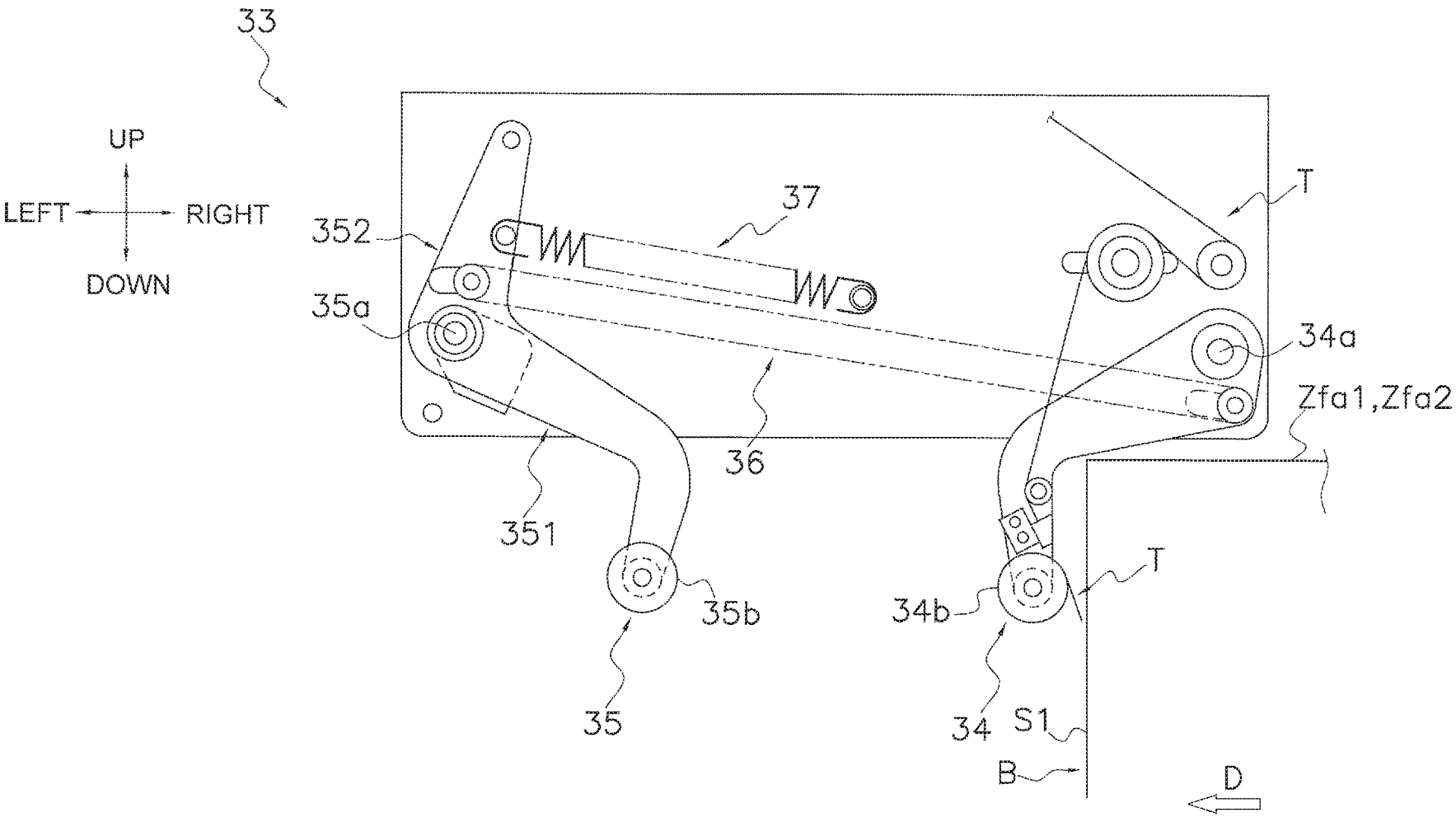
FIG. 6A is a front view of the tape-affixing section before the tape begins to be affixed to the cardboard box.
Figure 6B:
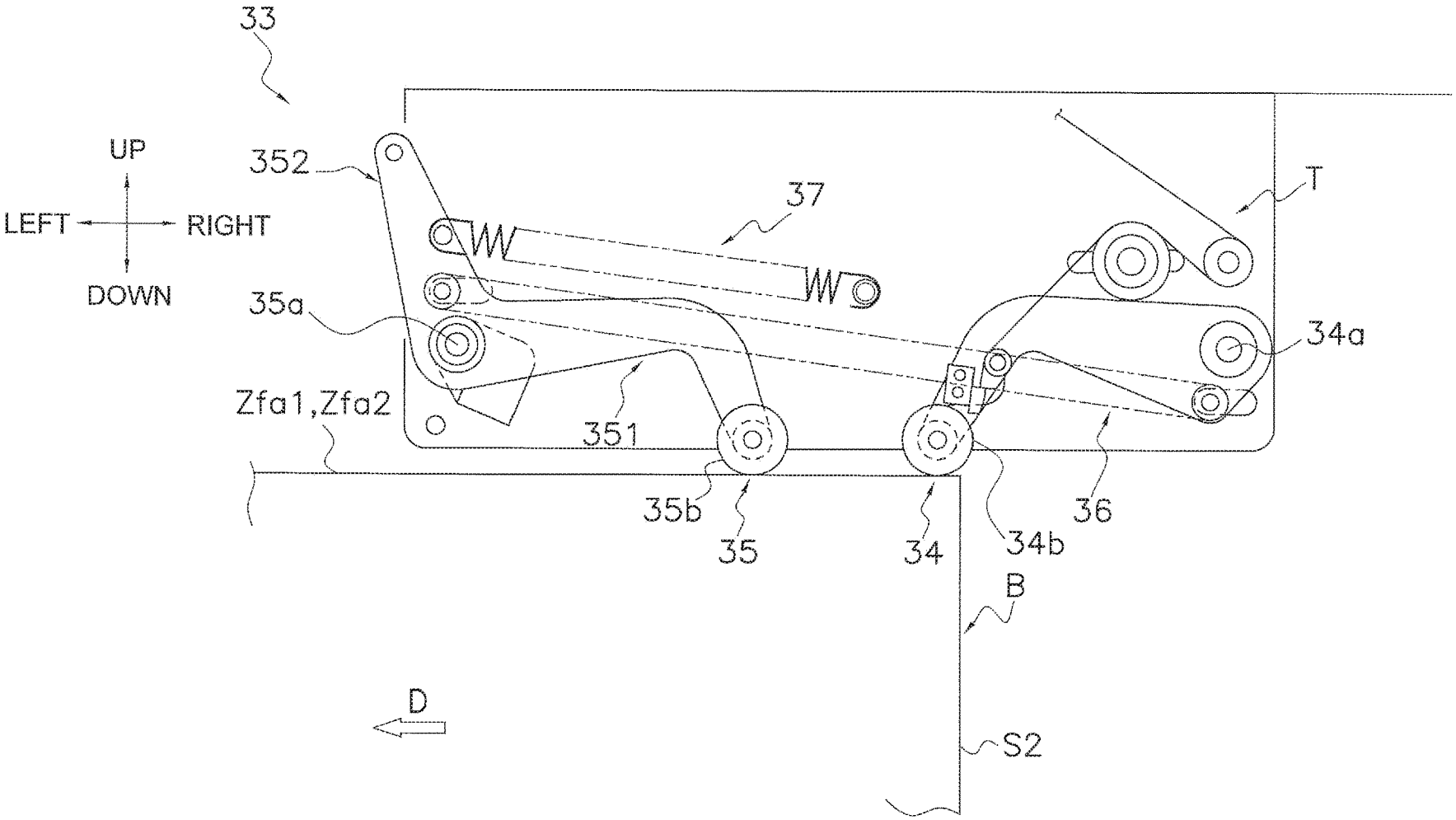
FIG. 6B is a front view of the tape-affixing section in the act of pushing and affixing the tape to the major top flaps of the conveyed cardboard box.
Figure 6C:
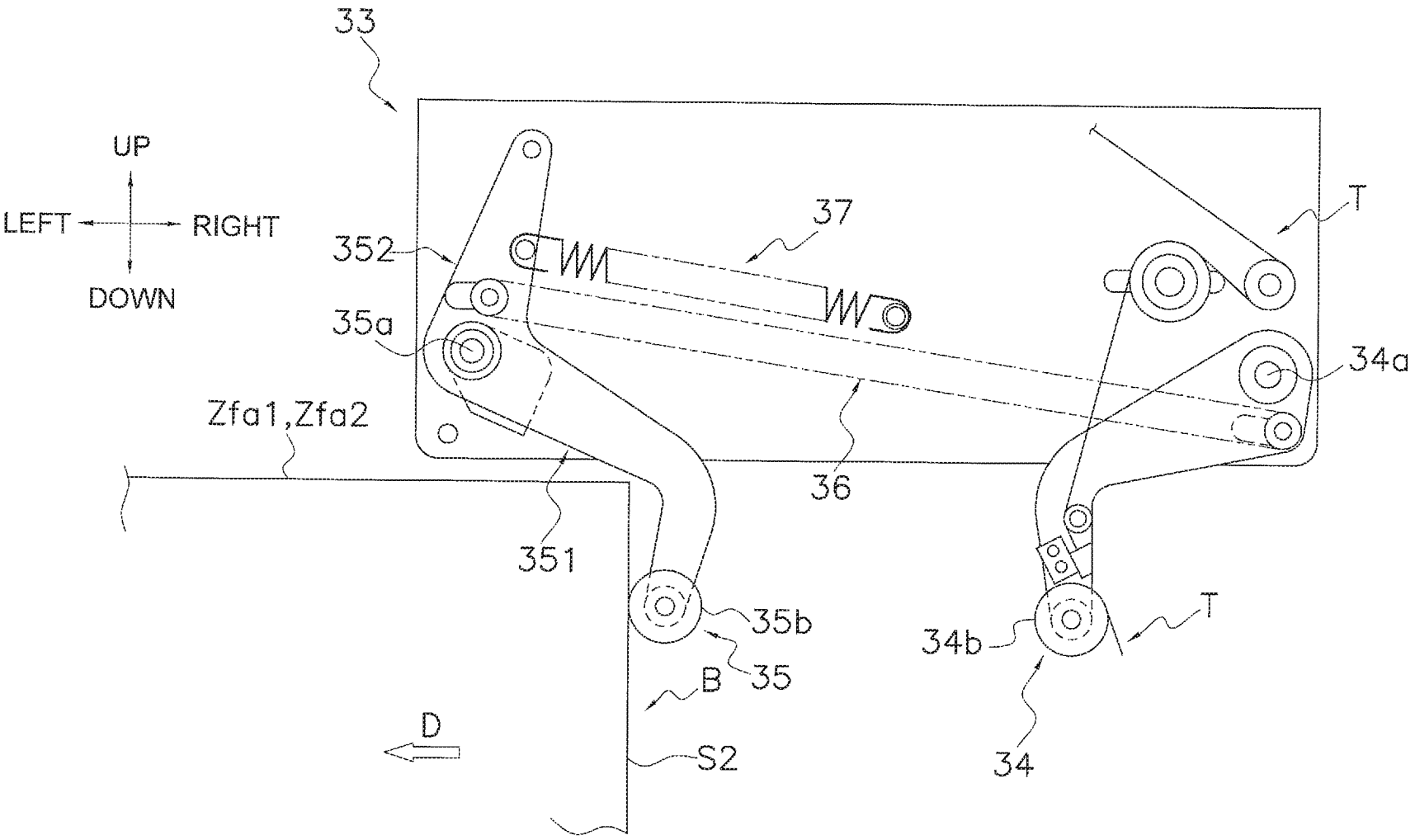
FIG. 6C is a front view of the tape-affixing section immediately after the affixing of the tape to the cardboard box is complete.

FIG. 5 is a schematic perspective view of the tape-affixing section 33. FIG. 6A is a front view of the tape-affixing section 33 before the tape T begins to be affixed to the cardboard box B. FIG. 6B is a front view of the tape-affixing section 33 in the act of pushing and affixing the tape T to the major top flaps Zfa1, Zfa2 of the conveyed cardboard box B. Furthermore, FIG. 6C is a front view of the tape-affixing section 33 immediately after the affixing of the tape T to the cardboard box 13 is complete.

In FIGS. 5, 6A, 6B, and 6C, the tape-affixing section 33 mainly has a first arm 34, a second arm 35, a link member 36, an elastic member 37, and a tape roll 39 around which the tape T is wound.

A circular plate 39*a* that rotates in synchronization with the rotation of the tape roll 39 is attached to a side surface of the tape roll 39, as shown in FIG. 5. The circular plate 39*a* is provided with a plurality of slits 391 having predetermined lengths in a diametrical direction and a circumferential direction. The slits 391 pass through the circular plate 39*a*.

In FIGS. 4 and 5, the plurality of slits 391 are formed in the circular plate 39*a*, but it is also acceptable for only one slit 391 to be formed.

A detection sensor 50 that detects the passing of slits 391 is disposed in a position opposite to the circular plate 39*a*.

(2-1) First Arm 34

The first arm 34 is capable of swinging about a swinging shaft 34*a* extending in a longitudinal direction. An affixing roller 34*b* is provided to a distal end of the first arm 34. The affixing roller 34*b* swings about the swinging shaft 34*a*.

The affixing roller 34*b* pushes the tape T against the first side surface SF1 and the major top flaps Zfa1, Zfa2. The tape T of the tape roll 39 is guided to the affixing roller 34*b*.

When the affixing of the tape T to the cardboard box B begins, an adhesive surface of the tape T guided from the tape roll 39 to the affixing roller 34*b* is caused to face to the upstream side in the conveying direction D of the ejecting conveyor 322 (to the right in the front view of FIG. 6A).

When the affixing of the tape T to the cardboard box B begins, a non-adhesive surface (on the side opposite from the adhesive surface) of the tape T guided to the affixing roller 34*b* is supported from the downstream side in the conveying direction D (the left in the front view of FIG. 6A) by the affixing roller 34*b*.

(2-2) Second Arm 35

The second arm 35 is capable of swinging about a swinging shaft 35*a* extending in the longitudinal direction. In a state before the affixing of the tape T to the cardboard box B has begun (the state in FIG. 6A), the second arm 35 has a first portion 351 extending downward relative to the swinging shaft 35*a*, and a second portion 352 extending upward relative to the swinging shaft 35*a*. The second portion 352 extends roughly to the side opposite from the first portion 351, relative to the swinging shaft 35*a*.

A pushing roller 35*b* is provided to an end part of the first portion 351. The pushing roller 35*b* pushes the tape T against the major top flaps Zfa1, Zfa2 and the second side surface SF2.

(2-3) Link Member 36

The link member 36 is a member that links the first arm 34 and the second arm 35 together. The proximity of the swinging shaft 34*a* of the first arm 34 and the proximity of the swinging shaft 35*a* of the first portion 351 of the second arm 35 are linked by a rod-shaped link member 36.

Due to the link member 36 linking the first arm 34 and the second arm 35 together, the first arm 34 and the second arm 35 swing together in opposite directions of each other.

When the cardboard box B conveyed to the ejecting conveyor 322 comes into contact with the first arm 34 in the state of FIG. 6A from the upstream side in the conveying direction D (the right side in the front view of FIG. 6A), the first arm 34 swings clockwise about the swinging shaft 34*a* as seen in the front surface view, and the affixing roller 34*b* is moved upward (see FIG. 6B).

At this time, because the first arm 34 is linked by the link member 36, force that pushes the second portion 352 leftward acts on the second arm 35. As a result, the second arm 35 swings counterclockwise about the swinging shaft 35*a* as seen in the front surface view, and the pushing roller 35*b* is moved upward (see FIG. 6B).

Due to the cardboard box B being conveyed by the ejecting conveyor 322, when the pushing roller 35*b*, which is pushing the major top flaps Zfa1, Zfa2 of the cardboard box B downward as in FIG. 6B, ceases to be in contact with the major top flaps Zfa1, Zfa2, the second arm 35 swings clockwise about the swinging shaft 35*a* as seen in the front surface view, and the pushing roller 35*b* is moved downward (see FIG. 6C).

At this time, rightward-pushing force acts on the first arm 34, which is linked with the second arm 35 by the link member 36. As a result, the first arm 34 swings counterclockwise about the swinging shaft 34*a* as seen in the front surface view and the affixing roller 34*b* is moved downward (see FIG. 6C).

One end of the elastic member 37 is secured to a frame portion (an immobile portion) of the tape-affixing section 33, and the other end is linked to the second portion 352 of the second arm 35. The elastic member 37 is, for example, a spring, but no limitation is provided thereby.

The elastic member 37, through elastic force, causes rightward-pulling force to act on the second portion 352 of the second arm 35. Due to rightward-pulling force acting on the second portion 352 of the second arm 35, the second arm 35 swings clockwise about the swinging shaft 35*a* as seen in the front surface view.

The second arm 35 is urged by the elastic force of the elastic member 37 so as to swing clockwise about the swinging shaft 35*a* as seen in the front surface view, whereby pushing force, which pushes the tape T against the major top flaps Zfa1, Zfa2 and the second side surface SF2 of the conveyed cardboard box B, arises in the pushing roller 35*b*.

Because the first arm 34 and the second arm 35 are linked by the link member 36 as described above, the first arm 34, due to the elastic force of the elastic member 37, swings counterclockwise about the swinging shaft 34*a* as seen in the front surface view.

The first arm 34, due to the elastic force of the elastic member 37, swings counterclockwise about the swinging shaft 34*a* as seen in the front surface view, whereby pushing force, which pushes the tape T against the first side surface SF1 and the major top flaps Zfa1, Zfa2 of the conveyed cardboard box B, arises in the affixing roller 34*b*.

(2-4) Detection Sensor 50

In FIGS. 4 and 5, the detection sensor 50 at least outputs different signals between during the time periods when a slit 391 is detected and during the time periods when a slit 391 is not detected.

The detection sensor 50 in the present embodiment is a so-called "reflective encoder" in which a light-emitting element and a light-receiving element are disposed on the same flat surface facing the circular plate 39*a*, and signals are generated by light reflection and non-reflection.

The detection sensor 50 is connected to the electronic controller 40 (hereinafter referred to as the controller 40 or control unit 40. The controller 40 determines that rotating of the tape roll 39 and unreeling of the tape are performed while signal changes from the detection sensor 50 are repeating. The electronic controller 40 preferably includes a microcomputer with a box-making apparatus control program that controls the various components and devices of the box-making system 1, as discussed herein. The electronic controller 40 can also include other conventional components such as an input interface circuit, an output interface circuit, and storage devices such as a ROM (Read Only Memory) device and a RAM (Random Access Memory) device. The microcomputer of the electronic controller 40 is programmed to control the box-making system 1. The memory circuit stores processing results and control programs such as ones for the operation of the various components of the box-making system 1 that are run by the processor circuit of the electronic controller 40. The electronic controller 40 is operatively coupled to the various sensors, motors, devices and components of the box-making system 1 in a conventional manner. The internal RAM of the electronic controller 40 stores statuses of operational flags and various control data. The internal ROM of the electronic controller 40 stores communication protocols and instructions for various operations of the box-making system 1. The electronic controller 40 is capable of selectively controlling any of the components of the control system of the box-making system 1, in accordance with the control program. It will be apparent to those skilled in the art from this disclosure that the precise structure and algorithms for the electronic controller 40 can be any combination of hardware and software that will carry out the functions of the present invention.

The detection sensor 50 at least emits an on or off signal when a slit 391 is detected; therefore, the circular plate 39*a* may be irradiated with laser light, and the passing of a slit 391 may be detected on the basis of a change in sensor output occurring due to a distance fluctuation when the slit 391 passes. A proximity switch or a photosensor may of course be used.

A camera that monitors the tape T unreeled from the tape roll 39 may be substituted as the detection sensor.

(3) Assessment of Tape-Affixing Abnormality

Regardless of the cardboard box B conveyed on the ejecting conveyor 322 having reached a detection position Pd (see FIG. 4), when there is no "repeating signal change" from the detection sensor 50, which indicates that the tape roll 39 is rotating, the controller 40 estimates that either the tape T is depleted or the tape T was not affixed to the cardboard box B, and assesses that there is a tape-affixing abnormality.

Moreover, regardless of the cardboard box B conveyed on the ejecting conveyor 322 passing through the detection position Pd, when there is continuous "repeating signal change" from the detection sensor 50, which indicates that the tape roll 39 is rotating, the controller 40 estimates that the tape T was not properly cut from the cardboard box B, and assesses that there is a tape-affixing abnormality.

Figure 7:
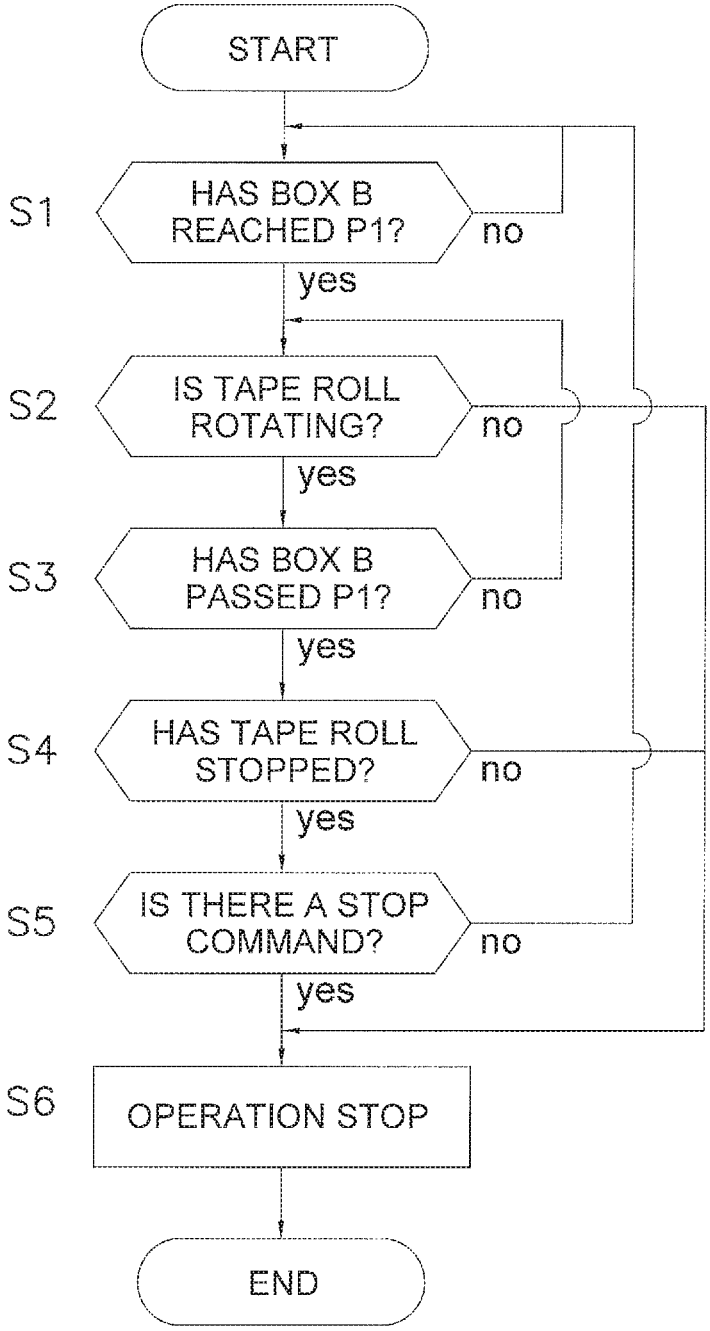
FIG. 7 is a flowchart of tape-affixing abnormality detecting control performed by a controller.

FIG. 7 is a flowchart of tape-affixing abnormality detecting control performed by the controller 40. The action of this control is described below with reference to FIG. 7.

(Step S1)

In step S1 of FIG. 7, the controller 40 determines whether or not a cardboard box B has reached the detection position Pd. Though not shown in any drawings, a passing sensor 335 to detect the passing of the cardboard box B is attached to the side of the detection position Pd of the ejecting conveyor 322.

The passing sensor 335 is configured from, for example, a light projector 335*a* and a light receiver 335*b* disposed facing each other with the ejecting conveyor 322 therebetween. When a cardboard box B passes between the light projector 335*a* and the light receiver 335*b*, the projected light is blocked, and a change in an electrical characteristic of the light receiver, caused by the decrease light quantity, takes the form of a detecting signal.

When the controller 40 determines that the cardboard box B has reached the detection position Pd, the sequence advances to step S2.

(Step S2)

Next, in step S2, the controller 40 determines whether or not the tape roll 39 is rotating. The circular plate 39*a* is coaxially attached to the side surface of the tape roll 39, and the slits 391 are formed along a radial direction of the circular plate 39*a*.

The detection sensor 50 is disposed in front of the circular plate 39*a*, and the detection sensor 50 outputs a signal indicating the distance to the circular plate 39*a*. Of the circular plate 39*a*, it is only the intervals of the slits 391 that are far from the detection sensor 50, and signals that differ with other intervals are therefore outputted.

In other words, when different signals are alternately outputted from the detection sensor 50, it means that the circular plate 39*a* is rotating, i.e., that the tape roll 39 is being unreeled.

When the controller 40 determines that "the tape roll 39 is rotating," the sequence advances to step S3.

In contrast, when the controller 40 determines that "the tape roll 39 is not rotating," the sequence advances to step S6, and the operation of the box-packing system 1 is stopped. This is because the tape roll 39 is not rotating even when the cardboard box B reaches the detection position Pd, and it is therefore estimated that the tape T has been all used up.

(Step S3)

Next, in step S3, the controller 40 determines whether or not the cardboard box B has passed the detection position Pd. Due to the cardboard box B passing the detection position Pd, an output signal of the passing sensor 335 stabilizes at a signal value equivalent to the signal value "before the cardboard box B reaches the detection position Pd," and the determination can therefore be made on the basis of this signal value.

When the controller 40 determines that "the cardboard box B has passed the detection position Pd," the sequence advances to step S4, and when the controller determines that "the cardboard box B has not passed the detection position Pd," the sequence returns to step S2.

(Step S4)

Next, in step S4, the controller 40 determines whether or not the tape roll 39 has stopped. When the cardboard box B passes the detection position Pd, the tape T is cut and separated from the cardboard box B, and the rotation of the tape roll 39 therefore stops.

In other words, because the circular plate 39*a* stops, the determination can be made on the basis of the fact that "different signals have ceased to be alternately outputted from the detection sensor 50."

When the controller 40 determines that the tape roll 39 has stopped, the sequence advances to step S5.

In contrast, when the controller 40 determines that "the tape roll 39 has not stopped," the sequence advances to step S6, and the operation of the box-packing system 1 is stopped. This is because the tape roll 39 was rotating even when the cardboard box B passed the detection position Pd, and it is therefore estimated that the tape T was not appropriately cut off and was pulled taut while still affixed to the cardboard box B.

(Step S5)

In step S5, the controller 40 determines whether there is or is not an operation stop signal. When the controller 40 determines that "there is an operation stop signal," tape-affixing abnormality detecting control is ended, and when the controller 40 determines that "there is no operation stop signal," the sequence returns to step S1.

(Step S6)

In step S6, the controller 40 stops the operation of the box-packing system 1. Aside from a regular stop command based on a production plan, when the tape roll 39 is determined in step S2 not to be rotating regardless of it being a period in which the tape roll 39 needs to unreel tape, or when the tape roll 39 is determined in step S4 to be rotating regardless of it being a period in which the tape roll 39 needs to stop unreeling tape, it is assessed that there is a tape-affixing abnormality and the box-packing system 1 is stopped.

In the event that the box-packing system 1 is to stop operating, there is no need for operation to stop immediately after an abnormality determination; for example, operation may be stopped during a period in which operation is readily restarted, such as after a cardboard box B on the ejecting conveyor 322 has been ejected.

Because the controller 40 can assess via the detection sensor 50 whether there is or is not abnormality in the affixing of the tape T, automatic inspection not involving visual inspection is possible.

(4) Characteristics (4-1)

In the box-making apparatus configured in the box-packing system 1, the controller 40 assesses abnormalities in the affixing of the tape T on the basis of a timing at which the cardboard box B passes the detection position Pd and a timing at which the tape roll 39 starts or stops the action of unreeling the tape T.

For example, the controller 40 can assess that there is an abnormality in the affixing of the tape when the tape T is not detected to have been unreeled by the tape roll 39, regardless of the cardboard box B having been conveyed to the detection position Pd, and automatic inspection not involving visual inspection is therefore possible.

(4-2)

The controller 40 assesses abnormalities in the affixing of the tape T also when there is a discrepancy of at least a predetermined amount between the timing at which the cardboard box B passes the detection position Pd and the timing at which the tape roll 39 starts or stops the action of unreeling the tape T.

(4-3)

Because the controller 40 monitors, through the detection sensor 50, the passing of a slits 391 provided to the circular plate 39*a* rotating in synchronization with the tape roll 39, the controller 40 not only can assess whether or not the rotating action of the tape roll 39, i.e., the tape unreeling action is occurring, but can also assess whether or not the tape is cut properly from the continuity of the detection signal, and furthermore can estimate the consumed amount of tape T from a rotation cycle.

(4-4)

In the box-making apparatus configured in the box-packing system 1, the controller 40 may stop operation during a period when operation is readily restarted, even when the controller 40 assesses that there has been an abnormality in the affixing of the tape T.

(5) Modifications (5-1) First Modification

In the above embodiment, the reaching of the cardboard box B conveyed on the ejecting conveyor 322 to the detection position Pd and the passing of the cardboard box B through the detection position Pd are detected by the passing sensor 335, but this configuration is not provided by way of limitation.

For example, in a case in which the same type of sensor as the passing sensor 335 is provided and the detection sensor 50 detects that the circular plate 39*a* is rotating from the time the cardboard box B is detected by one passing sensor until the time the box is detected by the other passing sensor, it is assessed that the proper tape-unreeling action of the tape roll 39 is performed and the tape T has appropriately affixed.

Conversely, when the detection sensor 50 cannot detect the rotation of the circular plate 39*a* from the time the cardboard box B is detected by one passing sensor until the time the box is detected by the other passing sensor, the proper tape-unreeling action is not performed by the tape roll 39, and it is assessed that either tape-affixing has failed or the tape T has been depleted.

Even in cases in which the detection sensor 50 detects that the circular plate 39*a* is rotating, when the detection sensor 50 detects rotation of the circular plate 39*a* after the other passing sensor detects the passing of the cardboard box B and a predetermined time has elapsed, it is assessed that the tape T has not been properly cut and the tape T is being pulled taut.

(5-2) Second Modification

There is also a method that does not involve use of a passing sensor. Specifically, a "fed amount of the ejecting conveyor 322 until reaching the position where tape begins to be affixed to the cardboard box B" and a "fed amount of the ejecting conveyor 322 until reaching the position where tape finishes being affixed to the cardboard box B", both of which begin at the time the cardboard box B is placed on the ejecting conveyor 322, are known in advance.

Accordingly, the elapsed time of the tape-affixing step can be calculated from the size and conveyed speed of the cardboard box B.

Therefore, when the on/off signal from the detection sensor 50 stops a fixed time sooner than the passing time, it is recognized that the tape T has been all used up.

Conversely, when the on/off signal from the detection sensor 50 yet continues even after the passing time has been elapsed, it is recognized that the tape T is pulled taut along with the conveying of the cardboard box B rather than being cut, and the tape T is being pulled out.

(6) Other Embodiments

In the above embodiment, the second arm 35 and the first arm 34 activate in coordination with each other, but for a predetermined action, the second arm 35 may be driven by a separate actuator.

Figure 8:
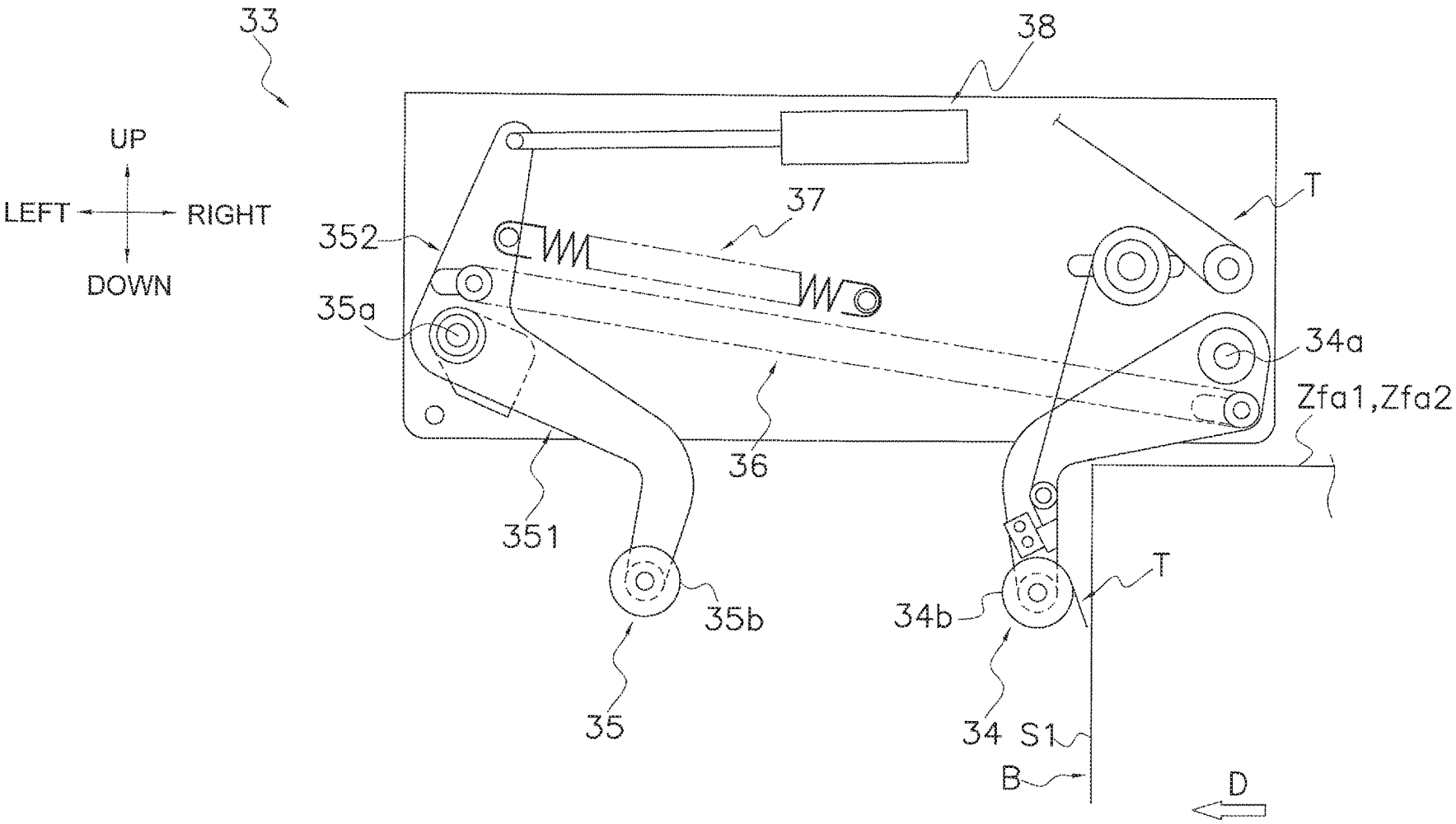
FIG. 8 is a front view of a tape-affixing section having an actuator, before the affixing of tape to the cardboard box is started

FIG. 8 is a front view of a tape-affixing section 33 having an actuator 38, before the affixing of the tape T to the cardboard box B is started. In FIG. 8, the rest of the configuration besides the actuator 38 is the same as that of the above embodiment (FIG. 6A), and a detailed description of the components and members other than the actuator 38 is therefore not given here.

The first portion 351 of the second arm 35 is linked with the actuator 38, as shown in FIG. 8. The actuator 38 is, for example, an air cylinder, but no limitation is provided thereby.

The action of the actuator 38 is controlled by the controller 40. The actuator 38 pushes the second portion 352 of the second arm 35 leftward.

As a result, the second portion 352 of the second arm 35 is subjected to force in the opposite direction of the elastic force exerted by the elastic member 37 on the second portion 352. Therefore, when the actuator 38 is activated, there is a weakening of the force that urges the second arm 35 so as to swing clockwise about the swinging shaft 35*a* as seen in the front surface view.

In other words, when the actuator 38 is activated, there is a weakening (lessening) of the pushing force of the pushing roller 35*b* to push the tape T against the major top flaps Zfa1, Zfa2 and the second side surface SF2 of the conveyed cardboard box B.

Because the first arm 34 and the second arm 35 are linked by the link member 36, the pushing force which had been created in the affixing roller 34*b* due to the imparting of elastic force by the elastic member 37, and which pushes the tape T against the first side surface SF1 and the major top flaps Zfa1, Zfa2 of the conveyed cardboard box B, is weakened (lessened) by the activating of the actuator 38.

In other words, the actuator 38 acts on the affixing roller 34*b* via the second arm 35, the link member 36, and the first arm 34, so that the pushing force of the affixing roller 34*b* lessens. As a result, deformation, etc., of the cardboard box B caused by the pushing force can be prevented.

INDUSTRIAL APPLICABILITY

The box-making apparatus according to the present invention is useful for box-packing systems in general, because abnormalities in the affixing of tape to a cardboard box can be detected by a method other than visual inspection.

REFERENCE SIGNS LIST

33 Tape-affixing section
39 Tape roll
39*a* Circular plate
40 Controller (control unit)
50 Detection sensor (detection unit)
322 Ejecting conveyor (conveying section)
391 Slit
B Cardboard box
T Tape

What is claimed:

1. A box-making apparatus comprising:

a tape-affixing section configured to affix tape unreeled from a tape roll to a cardboard box assembled into a box shape;

a first detection unit including a sensor positioned adjacent to the tape roll and configured to detect rotation of the tape roll as the tape is undergoing unreeling action from the tape roll;

a second detection unit configured to detect whether or not the cardboard box has passed a detection position after starting an action of affixing of the tape;

a conveying section configured to convey the cardboard box during tape affixing; and an electronic controller is configured to monitor the conveyed state of the cardboard box and the unreeled state of the tape and determine whether or not there are abnormalities in the affixing of the tape in response to detecting by the first detection unit and the second detection unit, the electronic controller being further configured to determine abnormalities in the affixing of the tape in response to the second detection unit detecting timing at which the cardboard box passes through the preset conveying position, and the first detection unit detecting timing at which the unreeling action of the tape is started or stopped.

2. The box-making apparatus according to claim 1, further comprising a circular plate that has a slit provided in a predetermined position and that rotates in synchronization with the tape roll, the sensor being adjacent to the circular plate detecting the slit as the circular plate and the tape roll rotate and sending a detection signal to the electronic controller.

3. The box-making apparatus according to claim 2, wherein the first detection unit emits an on or off signal when the slit is detected.

4. The box-making apparatus according to claim 2, wherein the electronic controller stops operation during a period during which operation is readily restarted when the electronic controller assesses that there has been an abnormality in the affixing of the tape.

5. The box-making apparatus according to claim 1, wherein the sensor of the first detection unit is an optical sensor to monitor the tape unreeled from the tape roll.

6. The box-making apparatus according to claim 5, wherein the electronic controller stops operation during a period during which operation is readily restarted when the electronic controller assesses that there has been an abnormality in the affixing of the tape.

7. The box-making apparatus according to claim 1, wherein the sensor of the first detection unit is a camera to monitor the tape unreeled from the tape roll.

8. The box-making apparatus according to claim 7, wherein the electronic controller stops operation during a period during which operation is readily restarted when the electronic controller assesses that there has been an abnormality in the affixing of the tape.

9. The box-making apparatus according to claim 1, wherein the electronic controller stops operation during a period during which operation is readily restarted when the electronic controller assesses that there has been an abnormality in the affixing of the tape.

* * * * *